US007155786B2

(12) United States Patent
Grimm

(10) Patent No.: US 7,155,786 B2
(45) Date of Patent: Jan. 2, 2007

(54) QUICK RELEASE BUCKLE

(75) Inventor: Michael B. Grimm, Evanston, IL (US)

(73) Assignee: Illinois Tool Works Inc, Glenview, IL (US)

( * ) Notice: Subject to any disclaimer, the term of this patent is extended or adjusted under 35 U.S.C. 154(b) by 35 days.

(21) Appl. No.: 10/966,522

(22) Filed: Oct. 15, 2004

(65) Prior Publication Data

US 2006/0080811 A1 Apr. 20, 2006

(51) Int. Cl.
*A44B 11/25* (2006.01)
*A44B 21/00* (2006.01)

(52) U.S. Cl. ..... 24/647; 24/665

(58) Field of Classification Search ..... 24/165, 24/171, 647, 650, 606–608, 629, 643, 648, 24/649, 664, 665, 633, 630, 631, 265 BC, 24/DIG. 57, DIG. 55
See application file for complete search history.

(56) References Cited

U.S. PATENT DOCUMENTS

| | | | | |
|---|---|---|---|---|
| 3,167,835 | A | 2/1965 | Bengtsson | |
| 4,171,555 | A | 10/1979 | Bakker et al. | 24/200 |
| 4,398,324 | A | 8/1983 | Bakker et al. | 24/230 R |
| 4,679,282 | A * | 7/1987 | Feng | 24/614 |
| 5,832,573 | A | 11/1998 | Howell | 24/664 |
| 6,678,925 | B1 | 1/2004 | Howell | 24/647 |

* cited by examiner

*Primary Examiner*—Jack W. Lavinder
(74) *Attorney, Agent, or Firm*—Mark W. Croll; Paul F. Donovan

(57) ABSTRACT

A two-part buckle is provided with male and female components and associated surfaces for engagement one against the other when the male buckle component is inserted in the female buckle component. A portion of the female buckle component defines a lever for deflecting the male buckle component and disassociating the engaging surfaces for releasing the male buckle component from the female buckle component. A lanyard is secured to the lever for operating the lever portion of the female buckle component.

19 Claims, 3 Drawing Sheets

QUICK RELEASE BUCKLE

FIELD OF THE INVENTION

The present invention relates to two-part buckles for connecting straps and, more particularly to quick release, load-bearing buckles for shoulder straps or the like on backpacks and other equipment.

BACKGROUND OF THE INVENTION

Buckles of various types are known for use in many different applications, including, for example, clothing, sporting gear, luggage, safety and other equipment, military gear and the like. Two-part buckle assemblies are known in a variety of different constructions. In a two-part buckle, cooperating first and second buckle parts are provided with structure having interlocking components, allowing releasable locking engagement of the components.

In a two-part buckle, it is known to provide a female buckle component attached to one part of an article and a male buckle component attached to another part of the article. For example, the female component may be anchored to one end of a strap and the male component connected to another end of the same strap or a different strap. The female buckle component defines a chamber or pocket into which the male component can be inserted, with various types of interlocking engagement provided within the pocket for elements of the female buckle component and of the male buckle component. It is known to disengage the male buckle component from the female buckle component by depressing one or more parts of the male buckle component from interlocking engagement with parts of the female buckle component.

Such known buckles have worked well in a variety of applications, both light duty and heavy duty. However, particularly for buckles designed to carry heavy loads, the procedure for disengaging the male buckle component from the female buck component can be difficult to perform, particularly if weight is still applied against the buckle. To disengage the buckle easily, it is sometimes necessary to independently support the weight of the article, to thereby remove force exerted against the buckle components. Even so, because of the resiliency of the buckle components, disengagement can be difficult. However, buckles that release more easily may have insufficient holding strength to support heavy loads.

In some applications and use of such buckles, it is necessary to release the buckle quickly in an emergency situation, with the user under personal duress. For example, military or police personnel often are required to carry heavy loads supported by straps and buckles around their shoulders. In a critical or emergency situation, it is desirable to release the load quickly so that the individual is unburdened from the load being carried. As one example, it is advantageous for a soldier to be able to release a backpack quickly if the soldier encounters the enemy. The heavy backpack is still supported by straps over the shoulders of the individual carrying it, and it is inconvenient and time consuming to attempt to separately support the backpack so that the buckle can be disengaged more easily.

Others, too, may experience emergency situations in which it is desirable to quickly release a buckle, even while still supporting a heavy load. Outdoor enthusiasts, such as mountain climbers, rock climbers, hikers and the like may encounter emergency situations in which it is desirable to release backpacks for personal safety reasons. Again, releasing known buckles while the buckle components are still under tension from supporting a load can be difficult, and independently supporting the load to make buckle release easier is time consuming and may not even be possible under the particular emergency situation.

What is needed in the art is a two-part buckle that has sufficient holding strength to support heavy loads, yet can be released quickly, easily and reliably while still supporting the load.

SUMMARY OF THE INVENTION

The present invention provides a quick release buckle having a male component insertable into a female component, with a toggling cover on the female component that can be moved to release and help eject the male component from the female component.

In one aspect thereof, the present invention provides a buckle with a female buckle component having a housing with a roof and a floor having an edge. A lid is pivotally connected to the housing and defines a pocket with the housing. The lid has a flange adjacent the floor; and a male buckle component has a forward end for insertion into the pocket. A portion of the forward end extends over and beyond the floor, confronting a portion of the flange. A lip of the forward end is engaged against the edge of the floor.

In another aspect thereof, the present invention provides a two-part buckle with a female buckle component and a male buckle component configured for insertion of the male buckle component into the female buckle component. Male buckle component surfaces and female buckle component surfaces are configured and arranged to engage one against another for securing the male buckle component in the female buckle component. A lever pivotally connected to the female buckle component confronts a portion of the male buckle component to deflect the male buckle component for repositioning the surfaces of the male buckle component away from the surfaces of the female buckle component to uncoupling the buckle.

In still another aspect thereof, the present invention provides a two-part buckle with first and second buckle components each having strap receiving ends for attaching the components to strap ends. The components each have surfaces thereof associated with each other for engagement one against another to couple the components to each other. One component has a lever connected thereto and underlying at least a part of the other component, for deflecting the other component to disengage the surfaces from each other and uncouple the components from each other.

An advantage of the present invention is providing a two-part buckle that is strong and secure and will support heavy loads.

Another advantage of the present invention is providing a two-part buckle that can be released quickly, easily and reliably with a simple motion, even under situations of duress or emergency.

Still another advantage of the present invention is providing a two-part buckle made of parts that are strong and that have multiple points of engagement to close securely for supporting heavy loads, yet can be released quickly and easily with a simple motion from the user.

A further advantage of the present invention is providing a buckle that can be secured to a web or strap easily, and that is of low profile to be unobtrusive and comfortable in use.

A still further advantage of the present invention is providing a two-part buckle that can be closed or latched quickly, easily and reliably.

Yet another advantage of the present invention is providing a buckle that is strong and secure and that will release non-catastrophically under high loads.

Other features and advantages of the invention will become apparent to those skilled in the art upon review of the following detailed description, claims and drawings in which like numerals are used to designate like features.

Figure 1:
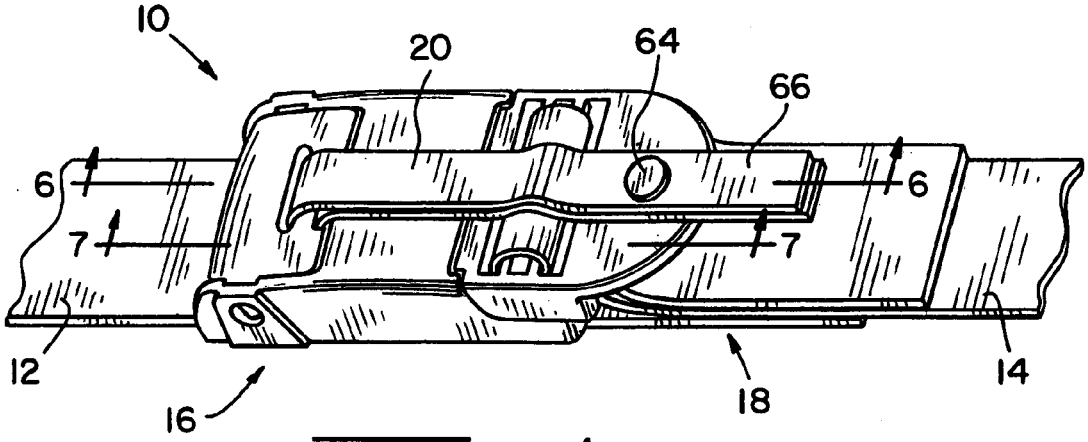
FIG. 1 is a perspective view of a buckle in accordance with the present invention secured to strap ends, with the buckle shown in a closed or engaged condition.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, and to FIG. 1 in particular, a quick release buckle 10 in accordance with the present invention is shown. Buckle 10 is illustrated secured to and between strap ends 12 and 14, which may be ends of different straps or may be opposite ends of a single strap. Strap ends 12 and 14 can be secured to an article or device such as a backpack, bag or other item, and buckle 10 can be associated with a variety of different articles, such as luggage, clothing, safety and other equipment or the like. The strap or straps having strap ends 12 and 14 also can be ends of a strap or belt intended to be secured over the shoulder of a user, or around the waist of the user. Buckle 10 also can be used with straps for holding objects to devices or things rather than to individuals.

Figure 2:
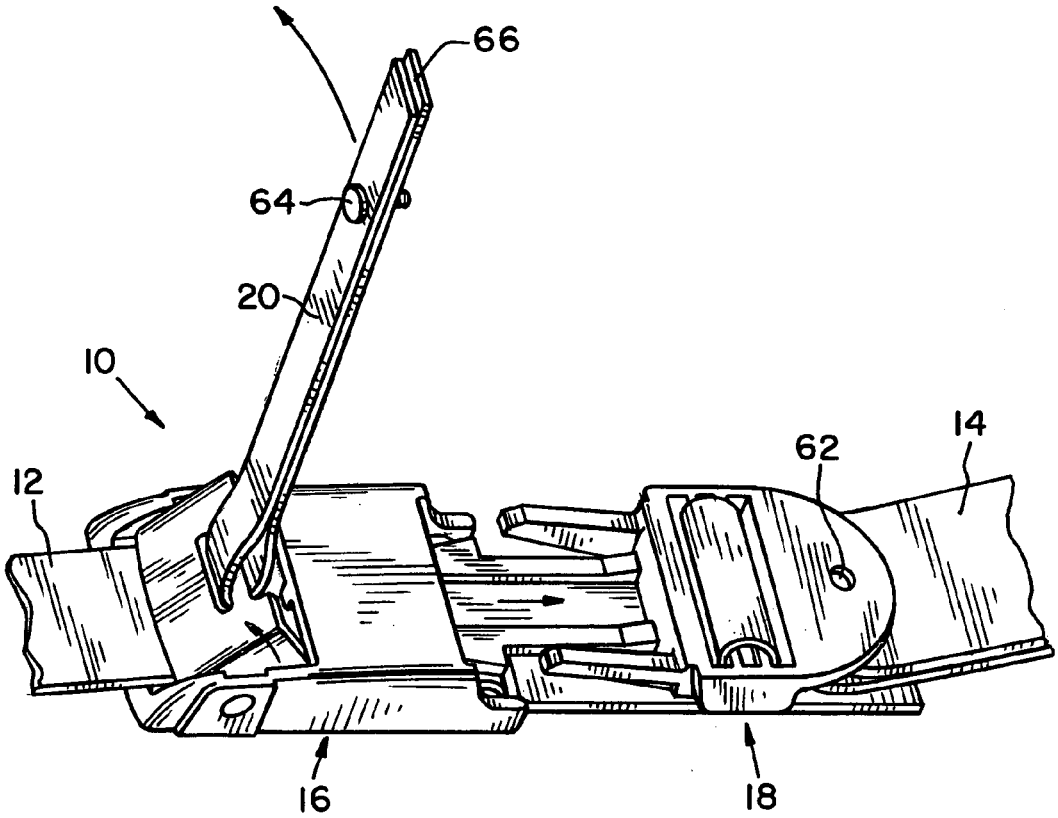
FIG. 2 is a perspective view of the buckle shown in FIG. 1, but illustrating the buckle in a disengaged condition, with the male component released from the female component.

As illustrated more clearly in FIG. 2, buckle 10 includes a female buckle component 16 and a male buckle component 18 secured to strap ends 12 and 14, respectively. Female buckle component 16 receives male buckle component 18 in a manner so as to secure male buckle component 18 within female buckle component 16 and prevent accidental or inadvertent disengagement of buckle 10. The manner in which female buckle component 16 and male buckle component 18 are secured releasably one to another will be described in greater detail hereinafter. Female buckle component 16 and male buckle component 18 can be made of a variety of materials, with numerous plastics being suitable.

Buckle 10 further includes a lanyard 20 which interconnects female buckle component 16 and male buckle component 18 as will be described in greater detail hereinafter. Lanyard 20 is a short strap or rope, and may be made of material similar to strap ends 12 and 14. Nylon is one suitable material.

Female buckle component 16 includes a housing 22 generally defining a pocket 24 for receiving male buckle component 18. Female buckle component 16 further includes a lid 26 which is pivotally connected to housing 22, and is pivoted for disconnecting and ejecting male buckle component 18 from female buckle component 16. Lid 26 forms an inner end of pocket 24, and is somewhat hollow for receiving a portion of male component 18, as will be described.

Housing 22 has a strap-receiving end 28 for receiving strap end 12. In the exemplary embodiment shown in the drawings, strap-receiving end 28 includes a slot 30 associated with other slots 32 and 34 spaced along housing 22, through which strap end 12 can be passed in a weaving-like manner. Alternatively, end 28 can be of a variety of configurations known to those skilled in the art, including, for example, a single bar around which strap end 12 is wrapped and secured in a non-adjustable fashion.

At strap-receiving end 28, housing 12 defines a chamber 36 having opposed walls 38 and 40 with apertures 42 and 44 therein, respectively. Lid 26 is positioned in chamber 36 and includes pins 46 and 48 that are received in apertures 42 and 44, respectively. Lid 26 is loosely received in chamber 36 and apertures 42 and 44, with pins 46 and 48 allowed to pivot within apertures 42 and 44 to provide a limited toggling motion of lid 26 relative to housing 22. Lid 26 defines a slot 50 through which lanyard 20 is passed. As shown in FIG. 2, the pivoting, toggling type motion of lid 26 in housing 22 can be effected by pulling lanyard 20 generally outwardly.

Figure 6:
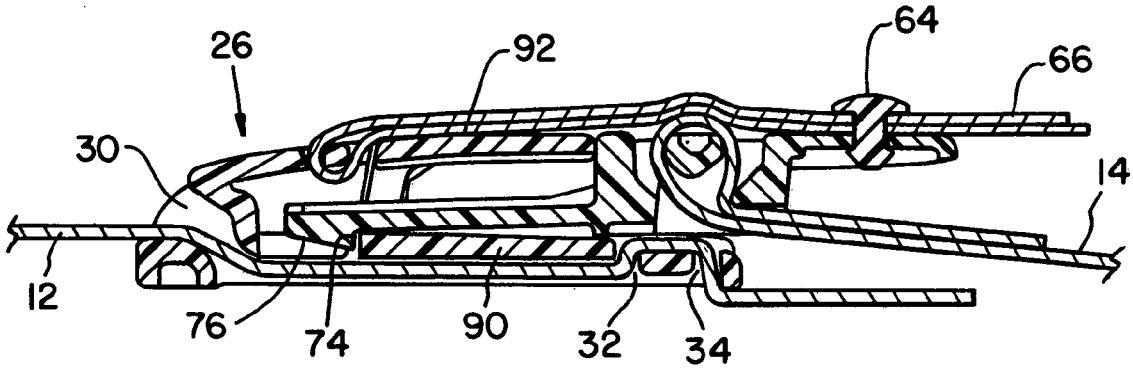
FIG. 6 is a cross-sectional view of the buckle shown in FIG. 1, taken along line 6—6 of FIG. 1.

Male buckle component 18 includes a strap-receiving end 52 for engaging strap end 14. The structure and arrangement of strap-receiving end 52 can differ from one application and use of buckle 10 to another, as required. In the exemplary embodiment shown in the drawings, strap-receiving end 52 includes a bar 54 defining slots 56 and 58 through which strap end 14 is wrapped, as shown in FIG. 6, allowing adjustment of the position of male buckle component 18 along the length of strap end 14. A forward end 60 of male buckle component 18 is received in pocket 24 of female buckle component 16. Rearward from forward end 60, a hole 62 is provided in male buckle component 18, and lanyard 20 includes a pin or snap 64 releasably secured in hole 62. Member 64 can include a deformable or compressible end larger in diameter than the diameter of hole 62, so that member 64 can be secured in and removed from hole 62 repeatedly. A distal end 66 of lanyard 20 extends beyond member 64. Thus, lanyard 20 can be secured against buckle 10 with only a short distal end 66 thereof being loose. Lanyard 20 will thereby lie against buckle 10 in a non-obtrusive manner.

Figure 3:
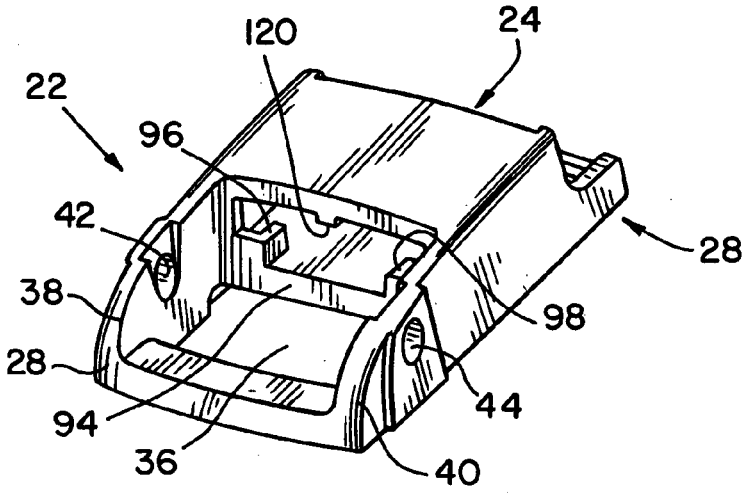
FIG. 3 is a perspective view of the housing for the female component of the buckle shown in FIGS. 1 and 2.
Figure 4:
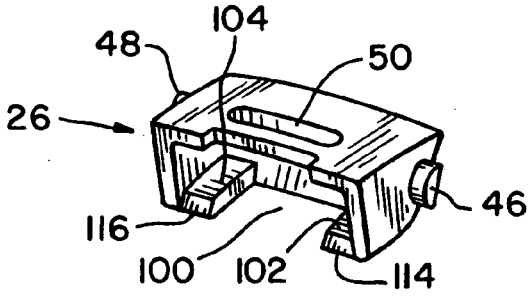
FIG. 4 is a perspective view of the lid for the female component of the buckle shown in FIGS. 1 and 2.
Figure 5:
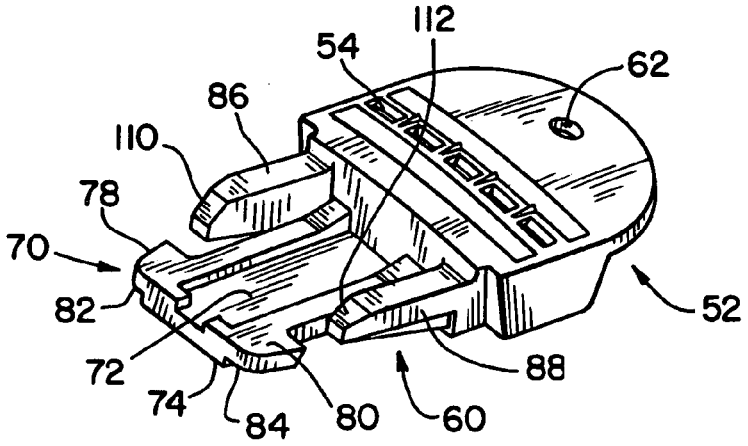
FIG. 5 is a perspective view of the male component of the buckle shown in FIGS. 1 and 2.

The manner in which male buckle component 18 is secured within pocket 24 of female buckle component 16 will be described with reference to the perspective views of individual buckle components in FIGS. 3–5 and the cross-sectional views of the engaged buckle 10 in FIGS. 6 and 7. It should be understood that buckle 10 can be used in various positions, including horizontal, vertical and angular orientations. Any references in this description to "top", "bottom", "upper", "lower" and similar terms implying direction or orientation are used for purposes of clarity in description relative to the orientations of the various views in the drawings, and should not be understood to limit the invention in any way.

Forward end 60 of male buckle component 18 includes a base 70 having a central portion 72 with a rearward facing lip 74 on a lower surface, near the distal end thereof. An angular face 76 leads to lip 74 from the distal end of central portion 72. Base 70 has a slight T-shaped configuration, with outwardly extending wings 78 and 80 from central portion 72. Wings 78 and 80 have sloped lower surface 82 and 84, respectively. Forward end 60 further includes forwardly projecting, upwardly oriented arms 86 and 88.

Pocket 24 of female buckle component 16 is defined by a floor 90 and a roof 92. Floor 90 terminates at an end 94. As illustrated in FIG. 6, floor 90 is of sufficient length such that when male buckle component 18 is fully inserted in female buckle component 16, base 70 extends beyond floor 90 to position lip 74 against floor end 94. Floor 90 is provided further with enlargements 96 and 98 near the corners thereof, adjacent floor end 94. During engagement of buckle 10, wing surfaces 82, 84 slide over and beyond enlargements 96, 98. Upon fill insertions of male buckle component 18 in female buckle component 16, wings 78, 80 and enlargements 96, 98 engage one against another, respectively. Sufficient separation is provided between the forward end of base 70 and the distal ends of arms 86 and 88 such that a slight wedging effect occurs of forward end 60 within pocket 24. Arms 86, 88 are disposed against roof 92 such that central portion 72 is held against floor 90 with lip 74 is held against floor end 94 and wings 78, 80 held against enlargements 96, 98. Thus, male buckle component 18 is not easily withdrawn from female buckle component 16 in that base 70 is held forcibly against floor 90, with three points of engagement between components 16 and 18. Lip 74 is held forcibly against floor end 94, and wings 78, 80 are held forcibly against enlargements 96, 98.

Lid 26 defines a central channel 100, with flanges 102 and 104 on opposite sides thereof. With male buckle component 18 fully inserted in female buckle component 16, portions of flanges 102 and 104 are disposed generally beneath and are confronted by wings 78 and 80. Lifting lid 26 relative to housing 22 elevates flanges 102 and 104 against wings 78 and 80, causing deflection of base 70 in an upward direction away from floor 90. Lip 74 is thereby elevated above the upper edge of floor 90 at floor end 94, and wings 78, 80 are elevated away from enlargements 96, 98. With the points of engagement thus removed, male buckle component 18 can be withdrawn from female buckle component 16. Even if weight is supported by buckle 10, such that force is applied in opposite directions on strap ends 12 and 14, buckle 10 can still be released. The prying, lever action from the rotation of lid 26 about pivot points defined by pins 46, 48 facilitates deflection of base 70 to disengage male component 18 from female component 16. Oppositely directed forces applied against female buckle component 16 and male buckle component 18 facilitate disengagement of buckle 10 by pulling male buckle component 18 from female buckle component 16.

When buckle 10 is designed for supporting heavy loads, the parts thereof are necessarily rigid and strong. To assist locking male buckle component 18 within female buckle component 16, chamfered edges 110, 112 are provided on the forward distal ends of arms 82 and 84 so that sliding engagement is facilitated of arms 82, 84 against roof 92. The sloping lower surfaces 82, 84 of wings 78, 80 and angular face 76 further facilitate coupling of buckle 10 by directing forward end 60 into pocket 24 and providing smooth, angular sliding surfaces. During final insertion of component 18 in component 16, angular surfaces 82, 84 of wings 78 and 80 slide over sloping surfaces 114 and 116 of flanges 102 and 104, respectively. Flanges 102, 104 are thereby deflected downwardly, to hold lid 26 in the downward or closed position. During disengagement, sloping surfaces 114, 116 of flanges 102, 104 lifting against surfaces 82, 84 elevate base 70 smoothly, and urge male buckle component 18 rearward to facilitate ejection of forward end 60 from pocket 24. The desired release force requirements can be achieved in buckle 10 through selection of appropriate material stiffness and through the angular relationships of adjacent surfaces in female buckle component 16 and male buckle component 18, such as, for example lip 74 and floor end 94.

Buckle 10 incorporates various additional alignment features to aid coupling of female component 16 and male component 18. Such alignment features can include a rib 120 in pocket 24 on roof 92, as well as the shape and size of inlets to pocket 24 and the overall size and shape of forward end 60. With the use of such features, proper alignment is aided to direct male component 18 into female component 16, and to ensure that male buckle component 18 is not inverted relative to the proper orientation with respect to female component 16. Coupling of buckle 10 is achieved easily even under difficult conditions, including darkness.

To uncouple buckle 10, distal end 66 of lanyard 20 is grasped and pulled outwardly to disengage pin 64 from hole 62. By further pulling lanyard 20 outwardly and upwardly, lid 26 is rotated, causing the upward levering action of flanges 102 and 104 against wings 78 and 80 described previously. As a result, male component 18 is uncoupled from female component 16, and can be withdrawn therefrom. When buckle 10 is reconnected, as described previously herein by inserting male component 16 in female component 18, after buckle 10 is fully coupled, lanyard 20 can be secured by aligning pin 64 with hole 62 and forcing the end of pin 64 into hole 62. Securing lanyard 20 to male buckle component 18 minimizes the potential for lifting lid 26 inadvertently.

Figure 7:
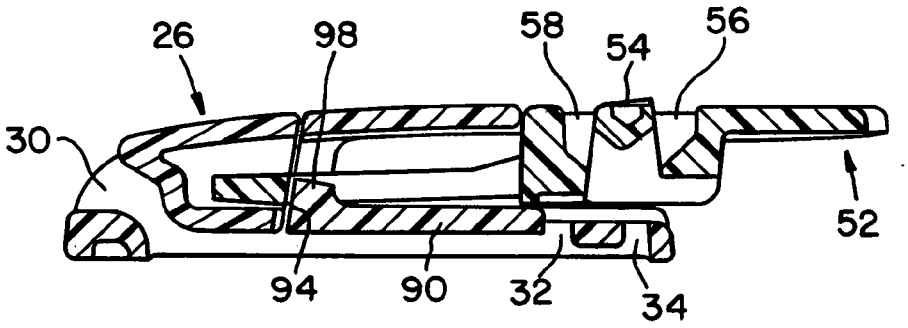
FIG. 7 is a cross-sectional view of the buckle shown in FIG. 1, taken along line 7—7 of FIG. 1.
Figure 8:
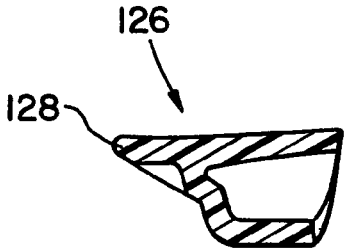
FIG. 8 is a fragmentary cross-sectional view of a second embodiment of a lid for the buckle of the present invention.

FIG. 8 is a cross-sectional view along a line similar to that of FIG. 7, but illustrating a second embodiment lid 126. Lid 126 is similar to lid 26, but has the further inclusion of an extension 128. Depressing extension 128 toggles lid 126 in a manner similar to pulling lanyard 20, to release male component 18 from female component 16. Extension 128 provides an alternative way to release buckle male component 18 that can be used instead of pulling lanyard 20, and facilitates the release of male component 18 if lanyard 20 is missing or otherwise not readily usable.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A buckle comprising;

a female buckle component having a housing with a roof and a floor having an edge, and a lid pivotally connected to said housing and defining a pocket with said housing, said lid having a flange adjacent said floor; and a male buckle component having a forward end for insertion into said pocket, with a portion of said forward end extending over and beyond said floor and confronting a portion of said flange such that said portion of said flange is positioned beneath said portion of said forward end, and a lip engaged against said edge of said floor wherein, said flange of said lid being a first flange, and said lid having a second flange spaced from said first flange, and said forward end of said male buckle component having portions thereof confronting at least portions of each said flange such that said portions of said flanges are positioned beneath said portions of said forward end.

2. The buckle of claim 1, said forward end including an arm projecting forwardly and upwardly for engagement against said roof.

3. The buckle of claim 1, said forward end including two arms projecting forwardly and upwardly for engagement against said roof.

4. The buckle of claim 1, said forward end including a base including said lip and at least one forwardly and upwardly projecting arm for engagement against said roof.

5. The buckle of claim 4, said base including a central portion having said lip and laterally projecting wings at a forward end of said base.

6. The buckle of claim 5, said floor including enlargements for engaging said wings.

7. The buckle of claim 6, further including a lanyard affixed to said lid.

8. The buckle of claim 1, including a lanyard secured to said lid.

9. The buckle of claim 1, with male buckle component surfaces and female buckle component surfaces configured and arranged to engage one against another for securing said male buckle component in said female buckle component, and a lever pivotally connected to said female buckle component and confronting a portion of said male buckle component to deflect said male buckle component for repositioning said surfaces of said male buckle component away from said surfaces of said female buckle component, for uncoupling said male buckle component from said female buckle component.

10. The buckle of claim 9, said lever having a lanyard affixed thereto for operating said lever by pulling said lanyard.

11. The buckle of claim 9, said lever including said lid.

12. The buckle of claim 11, including a lanyard secured to said lid.

13. The buckle of claim 12, said lanyard being detachably secured to said male buckle component.

14. The buckle of claim 13, said lanyard having a member and said male buckle component defining a hole for releasably receiving said member.

15. The buckle of claim 1, wherein each of said female buckle component and said male buckle component have strap receiving ends for attaching said components to strap ends, said female and male buckle components each having surfaces thereof associated with surfaces of the other thereof in engagement one against another for coupling said components to each other, and said female buckle component having a lever connected thereto, said lever underlying at least a part of said male buckle component, said lever movable against said male buckle component for deflecting said male buckle component to disengage said surfaces of said male buckle component from said surfaces of said female buckle component to uncouple said female and male buckle components from each other.

16. The buckle of claim 15, including a lanyard secured to said lever for operating said lever by pulling said lanyard.

17. The buckle of claim 16, said lanyard having a distal end releasably secured to said second component.

18. The buckle of claim 17, said second component defining a hole therein, and said lanyard having a member received in said hole.

19. A buckle comprising:

a female buckle component having a housing with a roof and a floor having an edge, and a lid pivotally connected to said housing and defining a pocket with said housing, said lid having a flange adjacent said floor;

a male buckle component having a forward end for insertion into said pocket, with a portion of said forward end extending over and beyond said floor and confronting a portion of said flange, and a lip engaged against said edge of said floor, said forward end including a base including said lip and at least one forwardly and upwardly projecting arm for engagement against said roof, said base including a central portion having said lip and laterally projecting wings at a forward end of said base, said floor including enlargements for engaging said wings; and a lanyard affixed to said lid, said lanyard having a member near a distal end thereof for securing said lanyard to said male buckle component.

* * * * *